United States Patent [19]

Miyake et al.

[11] Patent Number: 4,562,108

[45] Date of Patent: Dec. 31, 1985

[54] HEAT-RETAINING MOISTURE-TRANSMISSIBLE WATER-RESISTANT FABRIC

[75] Inventors: Masao Miyake, Otsu; Teruo Akita, Kusatsu, both of Japan

[73] Assignee: Asahi Kasei Textiles Ltd., Osaka, Japan

[21] Appl. No.: 678,326

[22] Filed: Dec. 5, 1984

Related U.S. Application Data

[62] Division of Ser. No. 487,949, Apr. 25, 1983, Pat. No. 4,510,194.

[30] Foreign Application Priority Data

| | | | |
|---|---|---|---|
| Apr. 28, 1982 | [JP] | Japan | 57-74365 |
| Dec. 29, 1982 | [JP] | Japan | 57-233171 |
| Jan. 14, 1983 | [JP] | Japan | 58-4722 |

[51] Int. Cl.[4] ..... B32B 7/02; B32B 3/26; B32B 27/40

[52] U.S. Cl. ..... 428/212; 428/215; 428/246; 428/316.6; 428/315.7; 428/315.9; 428/423.3

[58] Field of Search ..... 428/212, 215, 245, 246, 428/248, 252, 315.7, 315.9, 315.5, 315.6, 316.6, 423.3, 423.5, 423.7, 424.7, 425.1, 904

[56] References Cited

U.S. PATENT DOCUMENTS

| | | | |
|---|---|---|---|
| 3,640,829 | 2/1972 | Elton | 428/904 |
| 3,971,315 | 7/1976 | Hansen | 428/315.5 |
| 4,258,100 | 3/1981 | Fujitani et al. | 428/316.6 |
| 4,342,811 | 8/1982 | Lopatin et al. | 428/315.5 |
| 4,429,000 | 1/1984 | Naka et al. | 428/315.9 |

FOREIGN PATENT DOCUMENTS

| | | | |
|---|---|---|---|
| 26076 | 3/1981 | Japan | 428/315.7 |
| 6604404 | 10/1966 | Netherlands | 428/315.9 |
| 4136344 | 5/1976 | United Kingdom | 428/246 |
| 915808 | 3/1982 | U.S.S.R. | 428/315.5 |

*Primary Examiner*—George F. Lesmes
*Assistant Examiner*—Beverly Johnson
*Attorney, Agent, or Firm*—Sprung Horn Kramer & Woods

[57] ABSTRACT

A heat-retaining moisture-transmissible water-resistant fabric which comprises (i) a fibrous substrate, (ii) a discontinuous polymer layer or a polymer layer having a multiplicity of interconnecting fine pores (layer A), formed on at least one surface of the substrate, and (iii) a polymer layer (layer B) formed on layer A, layer B contains 15 to 70 wt. %, based on the polymer of the layer B, of heat ray-reflecting fine metal pieces and has a multiplicity of interconnecting fine pores communicating from the surface to the interior and also has on the surface thereof fine pores, most of which have a size not larger than 5 μm. The fabric may comprise, in lieu of layer B, (iv) a microporous polymer film layer (layer C), formed on layer A and having a multiplicity of interconnecting fine pores communicating in all the direction in the interior of layer C, most of which have a size of at least 1 μm, and (v) a polymer layer (layer D) containing 10–70 wt. % based on the polymer of the layer D, of a heat ray-reflecting fine metal pieces and having on the surface thereof fine pores having a size smaller than 0.5 μm and also having fine pores communicating with said fine surface pores, most of which have a size not larger than 1 μm.

9 Claims, 6 Drawing Figures

HEAT-RETAINING MOISTURE-TRANSMISSIBLE WATER-RESISTANT FABRIC

This is a division of application Ser. No. 487,949 filed Apr. 25, 1983, now U.S. Pat. No. 4,510,194.

BACKGROUND OF THE INVENTION (1) Field of the Invention

The present invention relates to a moisture-transmissable water-resistant fabric excellent in the heat-insulating and -retaining properties.

(2) Description of the Prior Art

Fabrics having water vapor transmission and water resistance in combination have been known. For example, Japanese Unexamined Patent Publication No. 53-19457 and No. 55-7483 disclose a fabric comprising a porous polymer layer formed on one surface thereof. Pores in the polymer layer interconnect with one another and communicate with fine pores on the surface of the polymer layer. Accordingly, the fabrics are moisture-transmissible. Most of the fine pores on the surface of the polymer layer have a size of not larger than 5 μm and do not allow liquid water to pass therethrough. Accordingly, the fabrics have water resistance. These moisture-transmissible water-resistant fabrics are used for ski wear, training wear, parkas, raincoats, tents and the like. However, since these fabrics are poor in heat-retaining property, when products of these fabrics are used in cold districts, the heat-retaining property must be increased by auxiliary means. For example, when the fabrics are used for winter clothes such as ski wear, large quantities of down or the like should be used so as to enhance the heat-retaining property. However, use of large quantities of down on the like results in various disadvantages. For example, clothes become bulky and body movement is restricted.

SUMMARY OF THE INVENTION

It is a primary object of the present invention to eliminate the foregoing defects of the conventional moisture-transmissible water-resistant fabrics, namely, to provide a fabric which has an improved heat-retaining property as well as good moisture transmission and water resistance.

In accordance with the present invention, there is provided a heat-retaining moisture-transmissible water-resistant fabric comprising a fibrous substrate, a discontinuous polymer layer or a polymer layer having a multiplicity of interconnecting fine pores ("layer A"), which is formed on at least one surface of the fibrous substrate, and a polymer layer ("layer B") containing 15 to 70% by weight, based on the polymer of layer B, of heat ray-reflecting fine metal pieces and having a plurality of interconnecting fine pores communicating from the surface to the interior, formed on layer A.

In accordance with the present invention, there is further provided a heat-retaining moisture-transmissible water-resistant fabric comprising a fibrous substrate, layer A formed on at least one surface of the fibrous substrate, a microporous polymer film layer ("layer C") having a multiplicity of interconnecting fine pores communicating in all the directions in the interior of layer C, most of which have a size of at least 1 μm, layer C being formed on layer A, and a polymer layer ("layer D") containing 10 to 70% by weight, based on the polymer of layer D, of a heat ray-reflecting fine metal pieces and having on the surface thereof fine pores having a size not larger than 0.5 μm and also having fine pores communicating with the fine surface pores, most of which have a size not larger than 1 μm, layer D being formed on layer C.

DESCRIPTION OF THE PREFERRED EMBODIMENTS

Figure 1:
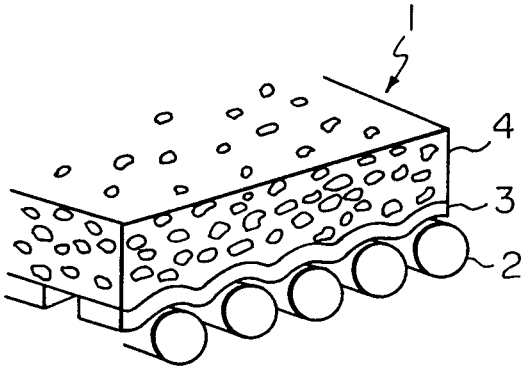
FIG. 1 is a model diagram of one embodiment of the water-resistant fabric having a two-layer structure according to the present invention.
Figure 2:
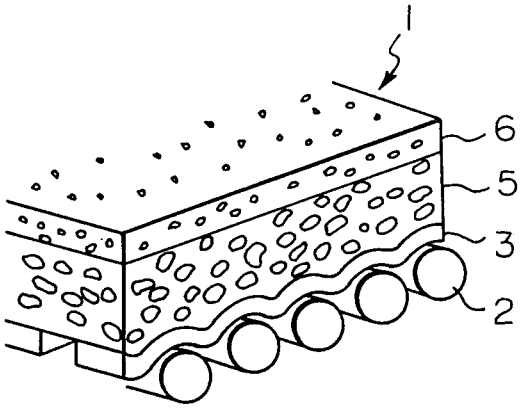
FIG. 2 is a model diagram of one embodiment of the water-resistant fabric having a three-layer structure according to the present invention.
Figure 3A:
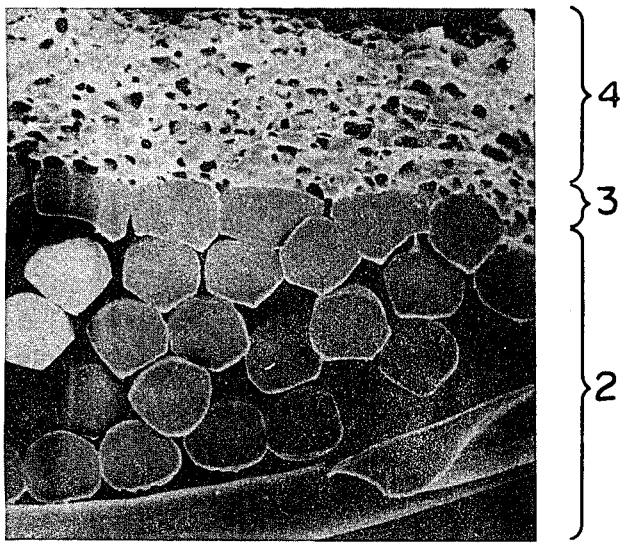
FIG. 3A is an electron photomicrograph (1000X) of a section of one embodiment of the water-resistant fabric having a two-layer structure according to the present invention.
Figure 4A:
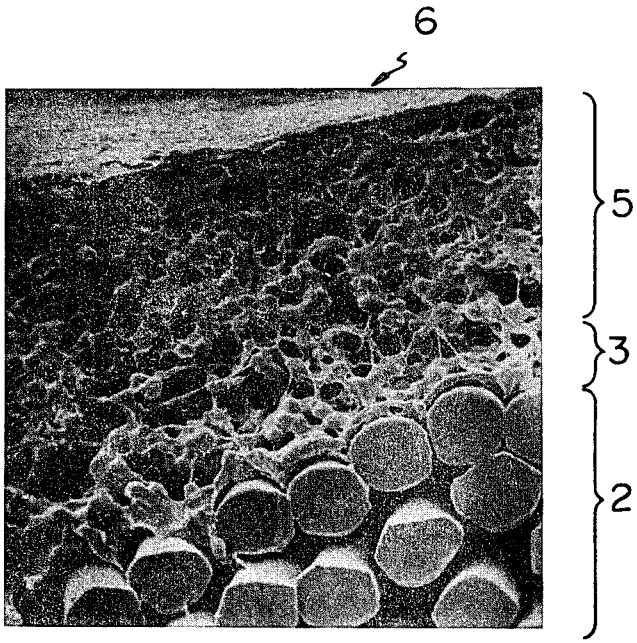
FIG. 4A is an electron photomicrograph (1000X) of the section of one embodiment of the water-resistant fabric having a three-layer structure according to the present invention.

The water-resistant fabric of the present invention is of a laminate structure as diagrammatically illustrated in FIGS. 1 and 2 and shown in FIGS. 3A and 4A which are electron photomicrographs (1000X) taken by a scanning electron microscope. More specifically, in one aspect of the present invention, as shown in FIGS. 1 and 3A, the water-resistant fabric 1 is of a two-layer laminate structure comprising a fibrous substrate 2, a layer A 3 formed on the substrate 2 and a layer B 4 formed on the layer A. In another aspect of the present invention, as shown in FIGS. 2 and 4A, the water-resistant fabric 1 is of the three-layer laminate structure comprising a fibrous substrate 2, a layer A 3 formed on the substrate, a layer C 5 formed on the layer A 3 and a layer D 6 formed on the layer C 5.

Synthetic fibers such as polyamide fibers, polyester fibers and polyacrylonitrile fibers, chemical fibers such as regenerated cellulose fibers and natural fibers such as cotton are used as the fibers for the fibrous substrate in the present invention. These fibers may be used either alone or as mixtures of these fibers. The fibrous substrate is used in the form of a woven fabric, a knitted fabric, a nonwoven fabric or the like. Among these, a woven fabric or knitted fabric is preferable.

As the polymer used for formation of the polymer layer A, a polyurethane, a polyacrylic acid ester, a polyamide, a vinyl chloride polymer, a vinylidene chloride polymer and a fluorine-containing polymer can be mentioned. These polymers may be used either alone or as a mixture of two or more thereof. In the present invention, a polyurethane and a polyacrylic acid ester are preferably used. Polyurethane is most preferable.

Layer A is a discontinuous polymer layer or a polymer layer having a plurality of interconnecting fine pores. Layer A is interposed between layer B and the fibrous substrate to increase the adhesion between layer B and the fibrous substrate and improve the water resistance of the fabric as a whole. By the term "discontinuous polymer layer" is meant, for example, a net-like polymer layer of a polymer layer composed of islands of appropriate sizes scattered on the fibrous substrate.

In polymer layer A having interconnecting fine pores, it is preferred that most of the fine pores have a size of 1 to 20 μm, more preferably 1 to 10 μm. The thickness of the polymer layer A is not particularly critical, but it is preferred to be in the range of from 1 to 50 μm, more preferably from 2 to 20 μm. If the thickness of polymer layer A is smaller than 1 μm, the effect of improving the adhesion and water proofness is reduced. In contrast, if the thickness of the polymer layer A exceeds 50 μm, the fabric becomes hard.

Layer B is a polymer layer containing 15 to 70% by weight, based on polymer layer B, of heat ray-reflecting fine metal pieces and having a plurality of interconnecting fine pores communicating from the surface to the interior of the water-resistant fabric. Polymer layer B is formed on the fibrous substrate through the interposed polymer layer A.

All solid metals such as aluminum, tin, nickel, silver, magnesium and chromium may be used as the heat ray-reflecting metal. Of these, aluminum is the most preferable because it has a low specific gravity and a high heat ray-reflecting effect. The fine metal pieces may be circular, angular or flat. The size of the fine metal pieces is preferably such that their major axis is about 0.1 to about 30 μm. If the amount of the fine metal pieces is smaller than 15% by weight based on layer B, the heat ray-reflecting effect is low. In contrast, if the amount of the fine metal pieces is larger than 70% by weight based on the polymer of layer B, the uniformity of the microporous polymer film is degraded and falling of the fine metal pieces is caused. The amount of the fine metal pieces is preferably in the range of from 20 to 50% by weight based on layer B. In order to enhance the heat ray-reflecting effect, a thin transparent polymer layer may be additionally formed on the fine metal piece-containing layer B to such an extent that the fine pores on the surface are not completely filled.

Figure 3B:
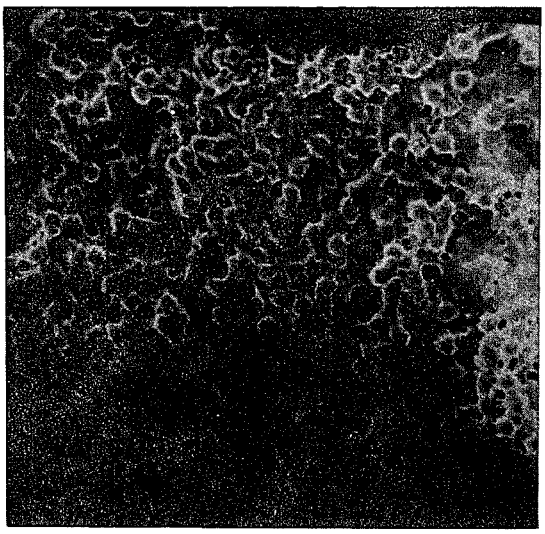
FIG. 3B is an electron photomicrograph (1000X) showing the surface of the water-resistant fabric shown in FIG. 3A.

A plurality of fine pores are present on the surface of layer B, as shown in FIG. 3B which is an electron microphotograph (1000X) taken by a scanning electron microscope. It is preferable that the pore size be not larger than 5 μm, especially not larger than 3 μm. In the interior of the layer B, there are present many pores interconnecting with one another in all the directions, which communicate with the fine pores on the surface and extend to the other surface. It is preferable that most of the pores have a size of 1 to 20 μm, more preferably 1 to 10 μm. The thickness of layer B is not particularly critical, but it is preferable to be in the range of from 3 to 100 μm.

The heat-retaining moisture-transmissable water-resistant fabric of the present invention has a basic structure in which the fibrous substrate is covered with the above-mentioned two polymer layers A and B. The heat ray-reflecting fine metal pieces are incorporated in the surface layer B to reflect the radiant heat from the interior, such as body heat, whereby the heat-retaining property is improved.

Since the surface of the layer B has fine pores, most of which have a size of not larger than 5 μm, that is, much smaller than the size of water drops such as rain drops, good water resistance is obtained. Furthermore, since many interconnecting fine pores are present in layer B and they communicate with the fine pores present on the surface, water vapor such as vapor from sweat is allowed to transmit through the fabric and, thus, good moisture transmission can be attained.

In accordance with one preferred embodiment for enhancing the above-mentioned advantageous effects of the present invention, the water-resistant fabric is of a three layer structure of substrate/layer A/layer C/layer D, as shown in FIGS. 2 and 4A. Namely, in this embodiment, layers C and D are used instead of layer B. Layer C has in the interior thereof pores interconnecting in all the directions, most of which have a size of at least 1 μm. Layer D contains 10 to 70% by weight, based on the polymer of layer D, of fine metal pieces and has on the surface thereof fine pores having a size of not larger than 0.5 μm and pores communicating with said fine surface pores, most of which have a size of not larger than 1 μm.

Since the pores present in layer C extend to both the surfaces of layer C, fine pores are present on both the surfaces of layer C. Since layer C has pores, most of which have a size of at least 1 μm, preferably 1 to 20 μm, a sufficient moisture transmission is maintained and a good heat-retaining property is given by air present in the interior pores.

It is preferred that the size of the fine pores on the surface of layer C be not larger than 5 μm, especially not larger than 3 μm. The thickness of layer C is not particularly critical, but it is preferable to be in the range of from 3 to 100 μm.

If fine metal pieces are incorporated in layer C in an amount of 5 to 70% by weight, preferably 20 to 50% by weight, based on the polymer of layer C, the radiant heat from a heat source, such as body heat, is effectively reflected and, therefore, the heat-retaining effect is further improved. If the amount of the metal fine pieces exceeds 70% by weight, the uniformity of the interconnecting pores is degraded, and the heat-retaining effect by the fine pores is reduced.

Layer D contains metal fine pieces in an amount of 10 to 70% by weight based on the polymer in layer D and is effective for smoothening the surface of layer C and reflecting the radiant heat from a heat source, such as body heat. Layer D is formed on the fibrous substrate through the interposed layer C.

Figure 4B:
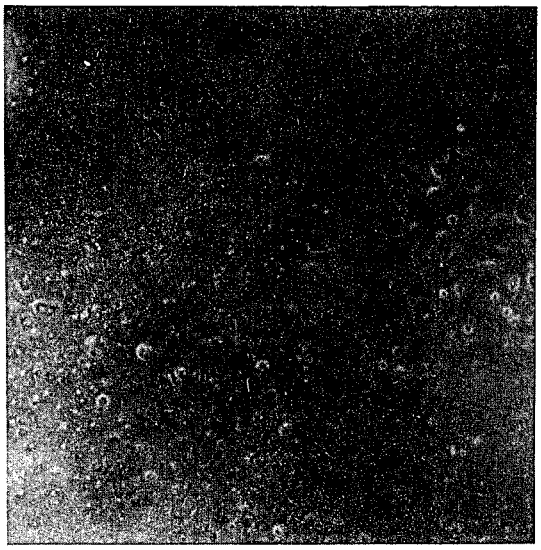
FIG. 4B is an electron photomicrograph (1000X) showing the surface of the water-resistant fabric shown in FIG. 4A.

In addition to the heat-retaining effect by the fine pores of layer C, the heat-retaining effect by reflection of the radiant heat from the heat source, such as body heat, by the fine metal pieces is effectively manifested. Fine pores having a size of not larger than 0.5 μm are present on the surface of layer D, as shown in FIG. 4B which is an electron microphotograph (1000X) taken by a scanning electron microscope. Pores communicating with these fine pores, most of which have a size of not larger than 1 μm, are present in the interior of layer D. Since both the fine surface pores and interior pores are small in the size, reduction of the brightness of the incorporated fine metal pieces is small and the moisture transmission is maintained at a high level. Layer C located below layer D has on the surface thereof fine pores having a size of not larger than 5 μm, preferably not larger than 3 μm, and also has in the interior thereof pores interconnecting in all the directions and being larger than the pores present in layer D, most of which have a size of at least 1 μm. Accordingly, the moisture transmission due to layer D is not degraded at all.

When the dry basis weight of the total of the fine metal pieces and polymer forming the polymer layer D is smaller than 1 g/m$^2$, the film layer is undesirably thin. When this dry basis amount is larger than 20 g/m$^2$, the intended fine pores are not formed on the surface of layer C and the moisture transmission is degraded, though the effect of reflecting the radiant heat is sufficient. When this dry basis amount is in the range of from 2 to 15 g/m$^2$, optimum results can be obtained. In this case, the thickness of layer D is in the range of from 1 to 10 μm.

If the amount of the fine metal pieces is smaller than 10% by weight based on the polymer of layer D, no substantial effect of reflecting the radiant heat is obtained. If the amount of the fine metal pieces is larger than 70% by weight based on the polymer of layer D, the film-forming property is degraded and falling of the fine metal pieces is caused. It is preferred that the amount of the fine metal pieces be in the range of from 15 to 60% by weight based on the polymer of layer D.

The process for manufacturing the heat-retaining moisture-transmissible water-resistant fabric of the present invention will now be described.

The manufacture of a fabric having a substrate/layer A/layer B structure is first described.

An organic solvent solution containing 5 to 40% by weight of the polymer is coated on the fibrous substrate to form layer A on the fibrous substrate. A solvent capable of dissolving the polymer therein, such as methyl ethyl ketone or dimethyl formamide, is used as the organic solvent. The coating is preferably accomplished by using a known coating machine such as a knife coater, a reverse roll coater, a kiss-roll coater or a gravure coater.

The polymer solution coated on the substrate can be coagulated by the conventional dry or wet coagulation method. According to the dry coagulation method, the polymer solution-coated substrate is passed through a hot air drier to evaporate the solvent of the polymer solution and coagulate the polymer. In order to render the polymer film porous, there may be adopted a method wherein an appropriate foaming agent is incorporated in the polymer solution and a method wherein an appropriate non-solvent is dispersed in the polymer solution. According to the wet coagulation method, the polymer solution-coated substrate is immersed in a non-solvent for the polymer, which is compatible with the solvent of the polymer solution, to effect coagulation by the extraction substitution of the solvent with the non-solvent, whereby a porous polymer film is formed. Then, the coated substrate is dried by a hot air drier.

The dry coagulation method and wet coagulation method will now be described in detail.

DRY COAGULATION METHOD

A dispersion (such as a water-in-oil type dispersion) formed by dispersing in a polymer solution a poor solvent (for example, water) for the polymer, which has a boiling point higher than the boiling point of the solvent (for example, methyl ethyl ketone) of the polymer solution, is coated. When the coated substrate is dried, the solvent of the polymer solution is first evaporated while the poor solvent is left, and the polymer is coagulated. The poor solvent is then evaporated and the polymer layer is dried. It is indispensable that the poor solvent be dispersed finely and uniformly in the polymer solution. In order to form desirable pores, it is preferred that the ratio of the poor solvent to the solvent be 5 to 50% by weight. If this ratio is lower than 5% by weight, completely communicating pores cannot be obtained. If the ratio is higher than 50% by weight, pores become too large and the intended porosity cannot be obtained.

WET COAGULATION METHOD

The substrate is coated with a polymer solution, and then the coated substrate is immersed in a mixed solution (coagulating bath) comprising the solvent (for example, dimethyl formamide) of the polymer solution and a non-solvent (for example, water) for the polymer, which is compatible with the solvent of the polymer solution, to effect extraction substitution of the solvent of the polymer solution with the non-solvent of the coagulating bath and thereby coagulate the polymer. It is preferable that the ratio of the solvent to the non-solvent in the coagulating bath be not higher than 40% by weight. If this ratio is higher than 40% by weight, the rate of substitution is low, and formed pores are not uniform, and pores having too large a size are formed. It is preferable that the coagulating bath be maintained at 0° to 50° C. If the temperature of the coagulating bath is outside this range, the rate of substitution is not appropriate and formed pores are not uniform.

Ordinarily, if the basis amount of the dry solid polymer adhering to the fibrous substrate is smaller than 5 g/m$^2$, a discontinuous polymer layer having a seemingly net-like structure is formed. If the polymer is coated in a dry basis amount of larger than 10 g/m$^2$, a polymer layer having a plurality of interconnecting fine pores is formed. If the polymer is coated by a gravure coating method, a discontinuous polymer layer is formed. Additives such as a crosslinking agent, a curing agent, a foaming agent, a surface active agent and a pigment may be added to the polymer solution, if desired.

After the dry or wet coagulation has been carried out, a polymer solution in an organic solvent having a 5 to 40% by weight concentration and containing 15 to 70% by weight of the fine metal pieces is coated on the so-formed polymer layer in the same manner as described above, and the dry coagulation or wet coagulation is similarly carried out.

According to another embodiment, the polymer solution containing the fine metal pieces is coated on a release paper by using a coating machine such as mentioned above. The polymer is coagulated and then laminated on the above-mentioned polymer layer.

The manufacture of a fabric having a substrate/layer A/layer C/layer D structure will now be described.

Layer A is formed on the fibrous substrate according to the above-mentioned method. A polymer solution in an organic solvent of a 5 to 40% by weight concentration is coated on layer A, then the dry or wet coagulation is effected to form layer C. If desired, 5 to 70% by weight, preferably 20 to 50% by weight, of fine metal pieces may be added to the polymer.

A polymer solution in an organic solvent having a 5 to 40% by weight concentration and containing 10 to 70% by weight, based on the polymer, of fine metal pieces is coated on the polymer layer C and, then, the dry or wet coagulation is effected to form layer D.

If a water repellant is further coated on the so-obtained laminated fabric, the water resistance is further increased. A fluorine type water repellant, a silicone type water repellant or a zirconium type water repellant may be used.

The heat-retaining moisture-transmissable water-resistant fabric of the present invention has improved heat retaining property and durability as well as good moisture transmission. Accordingly, the fabric of the present invention can be widely used for production of winter clothes such as ski wear, mountain parkas and warm-up jackets.

The present invention will now be described in detail with reference to the following examples, that by no means limit the scope of the invention.

The properties of fabrics obtained in these examples were determined according to the following methods.

[WATER PRESSURE RESISTANCE]

The water pressure resistance was determined according to method B (high water pressure method) of Japanese Industrial Standard (JIS) L-1092 described below.

Four test pieces having a size of about 15 cm×15 cm were collected from a sample fabric and attached to a water pressure resistance tester. Water pressure was applied at a rate of 0.1 kgf/cm$^2$ (98.1 kPa) per minute. The water pressure (mm$H_2O$) was measured when water was leaked out from the back side of the test piece at three points. The test was thus conducted on four test pieces and a mean value was calculated.

[MOISTURE TRANSMISSION]

The moisture transmission was determined according to the method of JIS K-6328 described below.

A moisture transmission test cup was filled with about 10 ml of distilled water, and a test piece was placed on the edge of the cup so that the polymer surface was located on the inner side. A lid was turned and fastened by screws to secure the test piece. Then, the test piece-attached cup ("test body") was carefully placed in a desiccator maintained at 40±1° C., in the bottom portion of which a sufficient amount of anhydrous calcium chloride was charged, so as not to shake the water. The test body was allowed to stand in this state for 2 hours; The test body was taken out and the total weight of the test body was measured. The test body was placed in the above-mentioned desiccator again, and the total weight of the test body was measured after 24 hours' standing. The moisture transmission (g/m$^2$) was calculated according to the equation shown below:

$$T = \frac{C - C_{24}}{C_F}$$

in which T stands for the moisture transmission (g/m$^2$), C stands for the weight (g) of the test body after 2 hours' standing, $C_{24}$ stands for the weight (g) of the test body after 24 hours' standing and $C_F$ stands for the moisture transmission area (m$^2$) of the cup. The test was conducted on three test pieces and a mean value was calculated.

[OVER-ALL COEFFICIENT OF HEAT TRANSFER]

A heat-retaining vessel having a temperature-controllable heat source and an opening formed in the upper portion was placed in a thermostat tank. A sample was placed on the opening and a detector of a heat flow meter was contacted with the surface of the sample. The difference between the temperature ($T_1$°C.) of the thermostat tank and the temperature ($T_2$°C.) in the heat-retaining vessel was kept constant. The heat flow (Q kcal/m$^2$.h) caused by this temperature difference ($T_2-T_1$) was measured. The over-all coefficient of heat transfer K (kcal/m$^2$.h°C.) was calculation according to the equation of $Q=K(T_2-T_1)$. A larger value of Q indicates a larger heat flow (that is, a larger heat loss) and a lower heat-retaining property.

In the following examples, parts and % are by weight unless otherwise specified.

EXAMPLE 1

In a tank, 100 parts of a water-in-oil type polyurethane resin dispersion (having a solid content of 20%) was mixed with 5 parts of methyl ethyl ketone, 25 parts of water and 2 parts of an isocyanate type crosslinking agent ("Soflanate #3001" supplied by Nippon Soflan Kako K.K. and containing 7.5% of an NCO group) under stirring to form a pasty coating dispersion (A).

A dyed nylon 66 tafetta fabric woven from 70-denier nylon 66 yarns as both the warps and wefts at a density of 210 yarns per inch was subjected to a pre-heat pressing treatment by using a calender roll maintained at 180° C. The coating dispersion A was coated on this fabric as the substrate in a dry solid deposited amount shown in Table 2 by means of a knife coater and the coated substrate was dried in a drying zone at a relatively low temperature varying from 50° C. to 70° C. and then at 90° C. to form a coating film layer A (the fabric having this layer A referred to as "laminate fabric A").

Then, 100 parts of the coating dispersion (A) was mixed with an aluminum paste ("STAPA-15HK" supplied by Asahi Chemical Industry Co. and having a fine metal piece content of 65% and an average particle size of 5 μm) in an amount shown in Table 1 to form a coating dispersion (B).

TABLE 1

| | Coating Dispersion (B) | |
|---|---|---|
| No. | Amount (parts) of coating dispersion (A) | Amount (parts) of aluminum paste |
| 1 | 100 | 2.6 |
| 2 | 100 | 4 |
| 3 | 100 | 8 |
| 4 | 100 | 15.7 |
| 5 | 100 | 70 |

Each of the coating dispersions (B) No. 3 and No. 4 shown in Table 1 was coated on the coated surface of the laminate fabric A by a roll coater and dried in a drying zone at relatively low temperatures varying from 40° C. to 60° C. and then at 80° C. to form a coating film layer B (the fabric having this layer B is referred to as "laminate fabric B").

Then, the laminate fabric B was subjected to a padding treatment with an aqueous 2.5% solution of a fluorine type water repellant ("Sumifluoil EM-11" supplied by Sumitomo Chemical Co., and having a solid content of 18%). The laminate fabric B was dried and heat-treated at 160° C. for 1 minute. The obtained results are shown in Table 2.

COMPARATIVE EXAMPLE 1

In the same manner as described in Example 1, the coating dispersion (A) was coated on the substrate in a dry solid deposited amount of 5 g/m$^2$ to form a coating film layer A. A coating film layer B was formed thereon in the same manner as described in Example 1 by using each of the coating dispersions (B) No. 2 and No. 5 in a dry solid deposited amount of 25 g/m$^2$. The laminate fabric, so obtained, was post-treated in the same manner as described in Example 1. The product obtained by using the coating dispersion (B) No. 2 was not different from the product of Example 1 in moisture transmission, but had a very poor heat-retaining property. The product obtained by using the coating dispersion (B) No. 5 had a good heat-retaining property, but was not satisfactory because the aluminum pieces readily fell out. The obtained results are shown in Table 2.

EXAMPLE 2

A dyed nylon tafetta fabric woven from 70-denier nylon 66 yarns as both the warps and wefts at a density of 210 yarns per inch was subjected to a pre-heat-pressing treatment by using a calender roll maintained at 180° C. Then, the fabric as the substrate was coated with a polyurethane dispersion ("CRISVON 8166" supplied by Dainippon Ink and Chemicals Inc. and having a solid content of 15%) so that the dry solid deposited amount was 5 g/m$^2$. The coating was dried in the same manner as described in Example 1.

A polymer solution formed by dissolving 30 parts of a polyurethane dispersion ("CRISVON 8166" having a solid content of 30%) and 5 parts of an aluminum paste in 65 parts of dimethyl formamide was coated on the polyurethane-coated surface of the nylon tafetta fabric by means of a knife coater so that the dry solid deposited amount was 25 g/m$^2$. The fabric was immersed in water (maintained at 25° C.) containing 5% of dimethyl formamide to effect coagulation. Then, the coated fabric was treated with the water repellant in the same manner as described in Example 1. The obtained results are shown in Table 2.

EXAMPLE 3

The polymer solution used in Example 2 was coated on a release paper by means of a knife coater so that the dry solid deposited amount was 20 g/m$^2$. Then, the coating was dried to effect coagulation. An adhesive ("CRISVON 8166" having a solid content of 10%) was coated on the film-coated surface in a coated amount of 15 g/m$^2$. When the adhesive became semi-dry, the same nylon tafetta fabric as that used in Example 2 was pressed to the coated surface of the release paper by means of a heated press roll. Then, the obtained laminate fabric was treated with the water repellant in the same manner as described in Example 1. The obtained results are shown in Table 2.

EXAMPLE 4

The same nylon 66 tafetta fabric as that used in Example 1 was coated with the same polyurethane solution as that used in Example 2 by means of a roll coater in a dry solid deposited amount of 10 g/m$^2$. The coating was then dried.

A coating solution comprising 30 parts of CRISVON 8166 (having a solid content of 30%) and 7.5 parts of an aluminum paste was coated on the surface of the polyurethane coating layer of the fabric by means of a knife coater in a dry solid deposited amount of 74 g/m$^2$. The obtained laminate fabric was post-treated in the same manner as described in Example 2. The obtained results are shown in Table 2.

EXAMPLE 5

A pasty coating dispersion [the same as coated dispersion (B) No. 1 shown in Table 1] formed by incorporating 2.6 parts of an aluminum paste into 100 parts of the pasty coating dispersion (A) used in Example 1 was thinly coated on release paper by means of a roller coater. The coating was then dried. The amount of the dry solid was 1.6 g/m$^2$. Then, the pasty coating dispersion (A) was coated on the dried coating by a roll coater so that the dry solid deposited amount was 20 g/m$^2$. When the coating became semi-dry, a polyester grey sheeting (having a basis weight of 110 g/m$^2$) was pressed to the coating by a heated press roll. The obtained results are shown in Table 2.

EXAMPLE 6

In a dissolving tank, 100 parts of a polyacrylic acid ester resin (in the form of a toluol solution having a solid content of 18%, supplied by Teikoku Chemical Industry Co.) was mixed in sequence with 20 parts of a fluorine type water repellant ("Scotchgard FC232" supplied by Sumitomo-3M Co.), 10 parts of acetone, 10 parts of water and 0.1 part of an isocyanate type cross-linking agent ("Catalyst #40" supplied by Teikoku Chemical Industry Co.) to form a pasty coating dispersion.

A dyed polyester tafetta fabric (75-denier warps, 50-denier wefts, density of 190 yarns per inch) was subjected to a pre-heat-pressing treatment by using a calender roll maintained at 150° C. The above-mentioned coating dispersion was coated on the fabric by means of a knife-over-roll coater and then dried in a drying zone at temperatures varying from 60° C. to 100° C. and then at 150° C. to effect coagulation, whereby a coating film was formed in a dry solid deposited amount of 5 g/m$^2$.

A metallic coating dispersion formed by incorporating 15 parts of aluminum pieces ("STAPA AV-10" supplied by Asahi Chemical Industry Co.) in 100 parts of the above-mentioned coating dispersion was coated on the coated surface of the fabric by means of a roll knife coater in a dry solid deposited amount of 9 g/m$^2$. The coating was then dried to effect coagulation.

The coated fabric was subjected to a padding treatment with an aqueous 2% solution of a fluorine type water repellant ("FC 220" supplied by Sumitomo-3M Co.), dried, baked for 2 minutes at 160° C. and then heat-pressed by a calender roll maintained at 150° C. The obtained results are shown in Table 2.

TABLE 2

| Example No. | Amount (g/m$^2$) of polymer of layer A | No. of coating dispersion (B) | Amount (g/m$^2$) of polymer plus metal in layer B | Amount (%) of metal in layer B | Water pressure resistance (mmH$_2$O) | Moisture transmission (g/m$^2$ · 24 hrs) | Over-all coefficient of heat transfer (kcal/m$^2$ · h · °C.) |
|---|---|---|---|---|---|---|---|
| 1-1 | 1 | 3 | 25 | 25.4 | Above 2000 | 3200 | 3.80 |
| 1-2 | 5 | 3 | 25 | 25.4 | Above 2000 | 3200 | 3.80 |
| 1-3 | 10 | 3 | 25 | 25.4 | Above 2000 | 3000 | 3.80 |
| 1-4 | 5 | 3 | 50 | 25.4 | Above 2000 | 2800 | 3.70 |
| 1-5 | 5 | 4 | 5 | 40 | Above 2000 | 3500 | 4.00 |
| 1-6 | 10 | 4 | 25 | 40 | Above 2000 | 3000 | 3.65 |
| Comparative Example 1-1 | 5 | 2 | 25 | 14.5 | Above 2000 | 3100 | 4.35 |
| Comparative Example 1-2 | 5 | 5 | 25 | 74.8 | Above 2000 | 2900 | 3.50 |

TABLE 2-continued

| Example No. | Amount ($g/m^2$) of polymer of layer A | No. of coating dispersion (B) | Amount ($g/m^2$) of polymer plus metal in layer B | Amount (%) of metal in layer B | Water pressure resistance ($mmH_2O$) | Moisture transmission ($g/m^2 \cdot 24$ hrs) | Over-all coefficient of heat transfer ($kcal/m^2 \cdot h \cdot °C.$) |
|---|---|---|---|---|---|---|---|
| 2 | 5 | Polymer solution | 25 | 26.5 | Above 2000 | 1900 | 3.70 |
| 3 | 15 | Polymer solution | 20 | 26.5 | Above 2000 | 1800 | 3.65 |
| 4 | 10 | Polymer solution | 75 | 35.1 | Above 2000 | 1500 | 3.50 |
| 5 | 20 | 1 | 1.6 | 9.9 | Above 2000 | 2800 | 4.35 |
| 6 | 5 | Pasty coating dispersion | 9 | 52 | 1600 | 2500 | 3.95 |

EXAMPLE 7

In a dissolving tank, 100 parts of a water-in-oil type polyurethane resin dispersion (having a solid content of 20%) was mixed with 5 parts of methyl ethyl ketone, 25 parts of water and 2 parts of an isocyanate type cross-linking agent ("Soflanate #3001" supplied by Nippon Soflan Kako K.K. and containing 7.5% of an NCO group) to form a pasty coating dispersion (A).

A dyed nylon 66 tafetta fabric woven from 70-denier nylon 66 warps and 70-denier nylon 66 wefts at a density of 210 yarns per inch was subjected to a pre-heat-pressing treatment by a calender roll maintained at 180° C. The above-mentioned coating dispersion (A) was coated on the fabric as the substrate by a knife coater and then the coating was dried in a drying zone at relatively low temperatures varying from 50° C. to 70° C. and then at 90° C. to form a coating film layer C in a dry solid deposited amount of 5 $g/m^2$ (the fabric having this layer C is referred to as "laminate fabric C").

A coating dispersion (C) was prepared by incorporating an aluminum paste ("STAPA 15HK" supplied by Asahi Chemical Industry Co. and having a fine metal piece content of 65% and an average particle size of 5 $\mu m$) in an amount shown in Table 3 in 100 parts of the coating dispersion (A).

TABLE 3

| No. | Coating Dispersion (C) Amount (parts by weight) of coating dispersion (A) | Amount (parts by weight) of aluminum Paste |
|---|---|---|
| 1 | 100 | 0 |
| 2 | 100 | 2 |
| 3 | 100 | 8 |
| 4 | 100 | 12 |
| 5 | 100 | 50 |
| 6 | 100 | 70 |

Each of the coating dispersions (C) No. 1, 2, 3 and 4 shown in Table 3 was coated on the coated surface of the laminate fabric C as indicated in Table 4 by a roll coater. Then, the coating was dried in a drying zone at relatively low temperatures varying from 40° C. to 60° C. and then at 80° C. to form a coating film layer D in a dry solid deposited amount of 25 $g/m^2$ (the obtained fabric having this layer D is referred to as "laminate fabric D"). Each of the coating dispersions (C) No. 2, 4, 5 and 6 shown in Table 3 was coated on the coated surface of the laminate fabric D as indicated in Table 4 and, then, the coating was dried in a drying zone at relatively high temperatures varying from 70° C. to 90° C. and then at 130° C. to form a coating film in a dry solid deposited amount of 4 $g/m^2$.

The laminate fabric was subjected to a padding treatment with an aqueous 2.5% solution of a fluorine type water repellant ("Sumifluoil EM-11" supplied by Sumitomo Chemical Co. and having a solid content of 18%). The fabric was dried and then heat-treated at 160° C. for 1 minute. The obtained results are shown in Table 4.

For comparison, the laminate fabric D (the aluminum content was 0 or 14.6%) was similarly subjected to the water repellant treatment (Comparative Example 3-1 or 3-2). The obtained results are shown in Table 4.

The products according to the present invention were excellent in heat-retaining property, moisture transmission and water resistance.

EXAMPLE 8

A dyed nylon 66 tafetta fabric woven from 70-denier nylon 66 warps and 70-denier nylon 66 wefts at a density of 210 yarns per inch was subjected to a pre-heat-pressing treatment by a calender roll maintained at 180° C. The fabric as the substrate was coated with a polyurethane dispersion ("CRISVON 8166" supplied by Dainippon Ink and Chemicals Inc. and having a solid content of 15%) so that the dry solid adhering amount was 5 $g/m^2$. Then, the coating was dried and coagulated.

A polymer solution was prepared by incorporating and dissolving 30 parts of a polyurethane dispersion ("CRISVON 8166" having a solid content to 30%) and 5 parts of an aluminum paste in 65 parts of dimethyl formaldehyde. This polymer solution was coated on the coated surface of the above-mentioned laminated fabric by a knife coater in a dry solid deposited amount of 20 $g/m^2$. The coated fabric was immersed in water containing 5% of dimethyl formaldehyde to effect coagulation, and then dried. The coating dispersion (C) No. 4 shown in Table 3 was coated on the coated surface of the laminated fabric by a roll coater so that the dry solid deposited amount was 4 $g/m^2$. The coated fabric was dried and post-treated in the same manner as described in Example 7. The obtained results are shown in Table 4. The product according to the present invention was excellent in the heat-retaining property, moisture transmission and water resistance.

TABLE 4

| Example No. | No. of coating dispersion (C) Layer C | Layer D | Aluminum content (%) Layer C | Layer D | Water pressure resistance ($mmH_2O$) | Moisture transmission ($g/m^2 \cdot 24$ hrs) | Over-all coefficient of heat transfer ($kcal/m^2 \cdot h \cdot °C.$) |
|---|---|---|---|---|---|---|---|
| Comparative Example 2 | 1 | 1 | 0 | 0 | Above 2000 | 3200 | 4.30 |
| 7-1 | 1 | 2 | 0 | 14.6 | Above 2000 | 3100 | 3.90 |

TABLE 4-continued

| Example No. | No. of coating dispersion (C) Layer C | Layer D | Aluminum content (%) Layer C | Layer D | Water pressure resistance ($mmH_2O$) | Moisture transmission ($g/m^2 \cdot 24$ hrs) | Over-all coefficient of heat transfer ($kcal/m^2 \cdot h \cdot °C.$) |
|---|---|---|---|---|---|---|---|
| 7-2 | 1 | 4 | 0 | 33.9 | Above 2000 | 3150 | 3.85 |
| 7-3 | 1 | 5 | 0 | 68.1 | Above 2000 | 3250 | 3.70 |
| 7-4 | 1 | 6 | 0 | 75.0 | 1900 | 3300 | 3.65 |
| 7-5 | 2 | 2 | 14.6 | 14.6 | Above 2000 | 3000 | 3.80 |
| 7-6 | 3 | 2 | 25.5 | 14.6 | Above 2000 | 3000 | 3.75 |
| 7-7 | 4 | 2 | 33.9 | 14.6 | Above 2000 | 3050 | 3.70 |
| Comparative Example 3-1 | 1 | — | 0 | — | Above 2000 | 3300 | 4.35 |
| Comparative Example 3-2 | 2 | — | 14.6 | — | Above 2000 | 3200 | 4.00 |
| 8 | Polymer solution | 4 | 26.5 | 33.9 | Above 2000 | 2700 | 3.70 |

We claim:

1. A heat-retaining moisture-transmissible water-resistant fabric comprising:

a fibrous substrate;

a polymer layer having a multiplicity of interconnecting fine pores (layer A), formed on at least one surface of the fibrous substrate; and a polymer layer (layer B) containing 15 to 70% by weight, based on the polymer of layer B, of heat ray-reflecting fine metal pieces and having a multiplicity of interconnecting fine pores communicating from the surface to the interior and also having on the surface thereof fine pores, most of which have a size of not larger than 5 μm, said layer B being formed on layer A.

2. A heat-retaining moisture-transmissible water-resistant fabric as set forth in claim 1, wherein the heat ray-reflecting fine metal pieces are contained in layer B in an amount of 20 to 50% by weight based on the polymer of layer B.

3. A heat-retaining moisture-transmissible water-resistant fabric as set forth in claim 1, wherein the size of the fine pores on the surface of layer B is not larger than 3 μm.

4. A heat-retaining moisture-transmissible water-resistant fabric as set forth in claim 1, wherein the size of the interconnecting fine pores in the interior of layer B is in the range of from 1 to 20 μm.

5. A heat-retaining moisture-transmissible water-resistant fabric as set forth in claim 1, wherein the thickness of layer B is in the range of from 3 to 100 μm.

6. A heat-retaining moisture-transmissible water-resistant fabric as set forth in claim 1, wherein the polymer of each of layers A and B is a polyurethane or a polyacrylic acid ester.

7. A heat-retaining moisture-transmissible water-resistant fabric as set forth in claim 1, wherein the heat ray-reflecting metal is aluminum, tin, nickel, silver, magnesium or chromium.

8. A heat-retaining moisture-transmissible water-resistant fabric as set forth in claim 1, wherein the heat ray-reflecting fine metal pieces have a major axis which is in the range of from 0.1 to 30 μm.

9. A heat-retaining moisture-transmissible water-resistant fabric as set forth in claim 1, wherein the fibrous substrate is a woven or knitted fabric.

* * * * *